US005779992A

United States Patent [19]

Higashi

[11] Patent Number: 5,779,992

[45] Date of Patent: Jul. 14, 1998

[54] PROCESS FOR HYDROTREATING HEAVY OIL AND HYDROTREATING APPARATUS

[75] Inventor: Hidehiro Higashi, Kitakyushu, Japan

[73] Assignee: Catalysts & Chemicals Industries Co., Ltd., Tokyo, Japan

[21] Appl. No.: 698,473

[22] Filed: Aug. 15, 1996

Related U.S. Application Data

[63] Continuation-in-part of Ser. No. 335,886, Nov. 15, 1994, Pat. No. 5,591,325.

[30] Foreign Application Priority Data

Aug. 18, 1993 [JP] Japan ..... 5-225177

[51] Int. Cl.[6] ..... B01J 8/04

[52] U.S. Cl. ..... 422/190; 208/49; 208/65; 208/210; 208/211; 208/212; 422/188; 422/189

[58] Field of Search ..... 208/210, 211, 208/65, 49, 212, 213; 422/188, 189, 190

[56] References Cited

U.S. PATENT DOCUMENTS

| | | | |
|---|---|---|---|
| 3,663,434 | 5/1972 | Bridge | 208/210 |
| 3,936,370 | 2/1976 | Henke et al. | 208/210 |
| 3,964,995 | 6/1976 | Wolk et al. | 208/210 |
| 4,657,664 | 4/1987 | Evans et al. | 208/211 |

*Primary Examiner*—Timothy McMahon

*Attorney, Agent, or Firm*—Webb Ziesenheim Bruening Logsdon Orkin & Hanson, P.C.

[57] ABSTRACT

A hydrotreating apparatus comprising (a') a fixed-bed reactor packed with a hydrotreating catalyst for hydrotreating a heavy oil and (b') a suspended-bed reactor packed with a hydrotreating catalyst for further hydrotreating the heavy oil hydrotreated in the fixed-bed reactor. According to the apparatus of the present invention, (a) feeding of a heavy oil to a fixed-bed reactor is disclosed packed with a hydrotreating catalyst to thereby effect hydrotreating of the heavy oil and (b) feeding of the heavy oil hydrotreated in the fixed-bed reactor to a suspended-bed reactor packed with a hydrotreating catalyst to thereby effect further hydrotreating of the heavy oil can be conducted, and therefore the period of hydrotreating of the heavy oil can be prolonged.

6 Claims, 6 Drawing Sheets

PROCESS FOR HYDROTREATING HEAVY OIL AND HYDROTREATING APPARATUS

This application is a continuation-in-part of U.S. patent application Ser. No. 08/335,886, filed Nov. 15, 1994, now U.S. Pat. No. 5,591,325.

BACKGROUND OF THE INVENTION

1. Field of the Invention

The present invention relates to a process for hydrotreating a heavy oil containing, as impurities, metals such as vanadium and nickel and various compounds such as sulfur and nitrogen compounds, and to an apparatus employed therefor.

2. Description of the Prior Art

Processes employing a fixed bed (a), a suspended bed (b) and first a suspended bed and then a fixed bed (c) have been proposed for hydrotreating a heavy oil containing, as impurities, metals such as vanadium and nickel and various compounds such as sulfur and nitrogen compounds.

The above processes have the following drawbacks.

(a) Drawbacks of the process in which a heavy oil is hydrotreated with a fixed bed The process having predominantly been employed for hydrotreating a heavy oil is one using a fixed bed. For example, this process comprises hydrotreating in a fixed-bed reactor having a first reaction chamber packed with a hydrodemetallization catalyst into which a heavy oil is fed to thereby hydrotreat the same and a second reaction chamber packed with a hydrodesulfurization catalyst in which the thus hydrotreated heavy oil is further hydrotreated.

However, when the removal of metals and sulfur and nitrogen compounds from a heavy oil is conducted to a high degree in a fixed-bed reactor, it has occurred that metals resulting from demetallization are converted to sulfides and deposit on the catalyst at the inlet part of the reactor to thereby deactivate the catalyst. Also, it has occurred that the outlet part of the reactor comes to have a high temperature due to the heat of reaction to thereby cause asphaltene at that part to suffer from thermal decomposition so as to produce coke which forms a solidified carbon compound known as a dry sludge to deposit on the catalyst, so that the catalyst is deactivated. Further, deposition of the dry sludge has occurred in pipes arranged downstream of the reactor.

Therefore, the process in which a heavy oil is hydrotreated with a fixed bed has a drawback in that it is difficult to prolong the period of hydrotreating operation of a heavy oil. Further, if a feed rate (flow rate) of a feed oil is increased for improving the hydrotreating capability, the pressure loss between inside and outside the reactor rises to thereby restrict the feed rate of the feed oil, with the result in a limitation on the improvement of the hydrotreating capability. Moreover, a feed oil containing foreign matters, such as slurry oil, causes choking of the catalyst bed, and this causes a rise in the pressure loss between inside and outside the reactor to thereby reduce the hydrotreating capability, with the result in that further hydrotreating operation becomes unfeasible. The slurry oil is also referred to as "decantation oil". The slurry oil mentioned above is a residual oil in the form of slurry that is produced as a by-product during the operation in a fluidized catalytic cracking unit and contains a small amount of a FCC catalyst fine powder.

(b) Drawbacks of the process in which a heavy oil is hydrotreated with a suspended bed Known processes in which a heavy oil is hydrotreated with a suspended bed include the H-oil process.

When the hydrotreating of a heavy oil is conducted with only a suspended bed, although the reaction temperature can be kept constant, there resides a drawback in that the contact area of the feed oil with the catalyst is small and the efficiency of utilization of the catalyst is poor, so that the reaction temperature must be increased for reducing contents of sulfur and nitrogen in the product oil to a low level. In result, thermal decomposition, rather than nuclear hydrogenation induced by the catalyst, is advanced to thereby degrade the product oil.

(c) Drawbacks of the process in which a heavy oil is hydrotreated first with a suspended bed and then with a fixed bed This process comprises the steps of first hydrotreating a heavy oil with a suspended bed and then hydrotreating the resultant heavy oil with a fixed bed. This process is aimed at preventing the deactivation of the catalyst caused by deposition of metals on the catalyst so as to prolong the hydrotreating operation period.

This process has a drawback in that thermal decomposition is advanced in the suspended bed in addition to hydrotreating of the heavy oil, whereby asphaltene in the form of a dry sludge deposits on the catalyst of the fixed bed in the subsequent stage, with the result in that not only the catalyst is deactivated but also the pressure loss between inside and outside the reactor rises to markedly decrease the hydrotreating capability. Therefore, it is difficult to prolong the period of hydrotreating operation of a heavy oil. Moreover, as well as in the aforesaid hydrotreating with the fixed bed, the hydrotreating capability can be hardly increased because of limitation on the flow rate of a feed oil, and additionally hydrotreating of a feed oil containing foreign matters is impossible.

In any of the above conventional processes for hydrotreating a heavy oil, it is requisite to discontinue the hydrotreating operation every about 10 months and to replace the employed catalyst with fresh one. This replacement takes a period as long as 10 to 30 days when the apparatus is for commercial purposes.

The inventors have noted that impurities contained in a heavy oil such as compounds containing vanadium, nickel and other metals, sulfur and nitrogen compounds have different reactivities with hydrogen during hydrotreating depending upon the impurities contained in different heavy oil fractions, such as resin and asphaltene, and found that, when impurities contained in the asphaltene or the like and having low reactivities with hydrogen are forcibly removed together with impurities contained in the resin or the like and having high reactivities with hydrogen to a high degree during the hydrotreating in a fixed-bed reactor, the fractions containing impurities having low reactivities with hydrogen are converted to coke, which deposits on the catalyst to thereby deactivate the catalyst with the result that the long-term hydrotreating operation becomes difficult. The present invention has been completed on the basis of this finding.

The objective of the present invention is to provide a novel process for hydrotreating a heavy oil, which permits prolongation of the hydrotreating operation period, and to provide a novel apparatus suitable therefor.

SUMMARY OF THE INVENTION

The hydrotreating apparatus for hydrotreating a heavy oil according to the present invention is an apparatus for efficiently conducting the steps of (a) feeding a heavy oil to a fixed-bed reactor packed with a hydrotreating catalyst to thereby effect hydrotreating of the heavy oil and (b) feeding the heavy oil hydrotreated in the fixed-bed reactor to a suspended-bed reactor packed with a hydrotreating catalyst to thereby effect further hydrotreating of the heavy oil.

The hydrotreating apparatus for hydrotreating a heavy oil according to the present invention comprises:

(a') a fixed-bed reactor packed with a hydrotreating catalyst for hydrotreating a heavy oil, and (b') a suspended-bed reactor packed with a hydrotreating catalyst for further hydrotreating the heavy oil hydrotreated in the fixed-bed reactor.

In the hydrotreating apparatus of the present invention, the fixed-bed reactor (a') is desirably packed with a hydrotreating catalyst for hydrotreating a heavy oil under mild conditions to remove impurities having high reactivities with hydrogen, and single or plural fixed-bed reactors may be present. The suspended-bed reactor (b') is desirably packed with a hydrotreating catalyst for removing impurities contained in the heavy oil hydrotreated in the fixed-bed reactor (a') and having low reactivities with hydrogen.

In the apparatus of the present invention, at least one fixed-bed reactor generally includes a feed means which is disposed at the upper part of the first fixed-bed reactor and serves to feed a heavy oil and hydrogen, and a discharge means which is disposed at the lower part of the last fixed-bed reactor and serves to discharge the heavy oil hydrotreated. The discharge means desirably includes a sampling port for sampling the heavy oil hydrotreated. According to the analysis of the sample withdrawn from the sampling port, the reaction conditions can be set so that only impurities having high reactivities with hydrogen are removed.

When plural fixed-bed reactors are present, the lower part of each reactor is connected with the upper part of the next reactor through a connecting pipe.

In the hydrotreating apparatus of the present invention, the suspended-bed reactor generally includes a connecting pipe for connecting the bottom of the suspended-bed reactor with the upper part of the suspended-bed reactor, a high-pressure pump disposed on the midway of the connecting pipe and for recycling the heavy oil through the suspended-bed reactor so as to maintain the catalyst in a suspended state, a catalyst withdrawal means for withdrawing a part of the catalyst used, a catalyst feed means for feeding a fresh catalyst in an amount equal to that of the withdrawn catalyst, and a gas-liquid separator for separating a reaction product discharged from the suspended-bed reactor into a product oil and a gaseous matter.

The suspended-bed reactor includes a connecting pipe for feeding the hydrotreated havy oil discharged from the last fixed-bed reactor to a bottom of the suspended-bed reactor.

When plural suspended-bed reactors are present, the upper part of each reactor is desirably connected with the bottom of the next reactor through a gas-liquid separator and a connecting pipe. In this case, the suspended-bed reactor includes a high-pressure pump for recycling a part of a product oil separated by a gas-liquid separator toward the bottom of the reactor so as to maintain the catalyst in the reactor in a suspended state.

The suspended-bed reactor may include a feed oil side feed means for feeding a feed oil containing vanadium and nickel (V+Ni) in a total amount of not more than 10 ppm to the suspended-bed reactor, in addition to the heavy oil hydrotreated in the fixed-bed reactor.

DESCRIPTION OF THE PREFERRED EMBODIMENT

Figure 1:
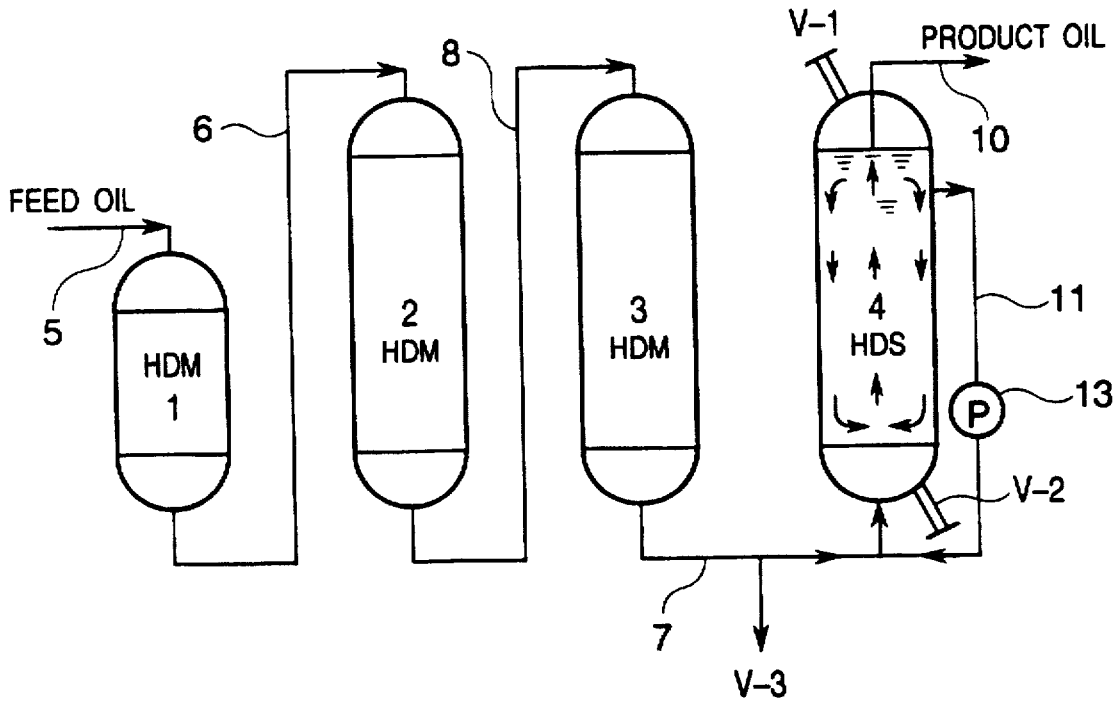
FIG. 1 shows one preferred embodiment of the hydrotreating apparatus according to the present invention.

The process for hydrotreating a heavy oil using the apparatus of the present invention comprises the steps of (a) feeding a heavy oil to a fixed-bed reactor packed with a hydrotreating catalyst to thereby effect hydrotreating of the heavy oil and (b) feeding the heavy oil hydrotreated in the fixed-bed reactor to a suspended-bed reactor packed with a hydrotreating catalyst in a suspended state to thereby effect further hydrotreating of the heavy oil.

The heavy oil used as a raw material in the process using the apparatus of the present invention preferably contains a fraction having a boiling point higher than 343° C. in an amount of at least 80%. Particularly, a hydrocarbon oil containing vanadium and nickel in a total amount of not less than 30 ppm is preferably employed. Examples of the hydrocarbon oils include vacuum gas oil, crude oil, atmospheric distillation residue and vacuum distillation residue.

It is preferred that the heavy oil be hydrotreated in the step (a) so that vanadium and nickel (V+Ni) be removed from the heavy oil at a demetallization rate of not greater than 80%, preferably from 5 to 80%, more preferably from 30 to 70% by weight based on the weight of the total of vanadium and nickel (V+Ni) contained in the heavy oil before hydrotreating.

When the step (a) is conducted under such severe conditions that the demetallization rate exceeds 80% by weight, it is likely that the asphaltene contained in the heavy oil is decomposed by heat to thereby cause side chains to detach from condensed aromatic rings of the asphaltene, so that the asphaltene can no longer maintain its micelle state to decompose in the form of radical-group-having condensed aromatic rings with the result that a dry sludge occurs. Also, it is likely that the asphaltene is cracked by heat to produce coke, which deposits on the catalyst to thereby deactivate the catalyst with the result that the hydrotreating operation for a prolonged period of time becomes unfeasible.

The hydrotreating catalyst employed in the above step (a) is preferably one composed of a hydrogenation metal component and an inorganic oxide carrier, having the following properties:

| | Range | Still preferred range |
|---|---|---|
| Pore volume (P.V) | at least 0.40 ml/g | 0.50–1.00 ml/g |
| Average pore diameter (P.D) | at least 90 Å | 90–2000 Å |
| Specific surface area (S.A) | at least 120 $m^2/g$ | 130–350 $m^2/g$ |
| Average diameter of catalyst particles (Dia) | at least 1/32 inch | 1/22–1/4 inch. |

Examples of the above hydrogenation metal components include metals of the groups VIA, VIII and V of the periodic table which are employed in the conventional hydrotreating catalyst, such as cobalt, nickel, molybdenum and tungsten.

For use, the above hydrogenation metal component is carried on an inorganic oxide carrier in the conventional amount, preferably in an amount of 3 to 30% by weight.

Examples of the above inorganic oxide carriers include those conventionally employed as the hydro-treating catalyst carrier, such as alumina, silica and silica-alumina.

For the purpose of removing impurities having high reactivities with hydrogen, the hydrotreating of a heavy oil in the step (a) is desirably carried out under the following conditions so that vanadium and nickel (V+Ni) are removed from the heavy oil at a demetallization rate of not more than 80% by weight based on 100% by weight of the total of vanadium and nickel (V+Ni) contained in the feed heavy oil.

| | Range | Still preferred range |
|---|---|---|
| Reaction temperature (°C.) | 320–410 | 340–390 |
| Reaction hydrogen pressure (kg/cm$^2$) | 50–250 | 100–200 |
| Liquid space velocity (hr$^{-1}$) | 0.1–2.0 | 0.3–1.5 |
| Ratio of hydrogen to oil (nM$^3$/kl) | 300–1200 | 400–1000. |

The effects desired in the present invention may not be obtained when the hydrotreating is conducted under the conditions falling outside the above ranges.

When the hydrotreating is conducted under the conditions falling below the above lower limits, the reaction may not proceed at a desired level to thereby render inevitable hydrotreating of the heavy oil in the step (b) under severe conditions, so that the effects desired in the present invention cannot be attained. On the other hand, when the hydrotreating is conducted under the conditions exceeding the above upper limits, the hydrotreating reaction may advance to an excess extent to thereby greatly promote the coke deactivation of the catalyst in the step (a), so that the life of the catalyst is shortened.

In a process using the apparatus of the present invention, although the step (a) may be carried out with the use of a single fixed-bed reactor, it is preferably conducted with the use of at least two fixed-bed reactors.

Below, description will be made with respect to the step in which the heavy oil hydrotreated in the step (a) is fed into a suspended-bed reactor packed with a hydrotreating catalyst to thereby effect further hydrotreating of the heavy oil, namely, the step (b).

The suspended-bed reactor to be used in the step (b) may be the conventional suspended-bed reactor as well as a moving-bed reactor or a ebullated-bed reactor.

In the step (b) of the process using an apparatus of the present invention, it is preferred that metals and sulfur and nitrogen compounds contained as impurities in a fraction of the heavy oil hydrotreated in the step (a) which has low reactivity with hydrogen, e.g., asphaltene be highly removed.

That is, in the step (b) of the process using the apparatus of the present invention, it is preferred that the heavy oil hydrotreated in the step (a) be further hydrotreated so that the resultant heavy oil has a content of metal, sulfur and nitrogen components smaller than that of the heavy oil hydrotreated in the step (a).

In the step (b), even if the heavy oil hydrotreated in the step (a) is further hydrotreated so as to highly remove metals, sulfur and nitrogen from the heavy oil with the result that the catalyst is deactivated, it is feasible to withdraw the deactivated catalyst from the suspended-bed reactor or to feed a fresh catalyst into the suspended-bed reactor in accordance with the degree of deactivation of the catalyst, without the need of discontinuing the operation of the suspended-bed reactor. Thus, continuous hydrotreating operation is ensured for a prolonged period of time.

That is, in the step (b) of the process using the apparatus of the present invention, part of the hydrotreating catalyst employed in the hydrotreating of the heavy oil may be withdrawn from the suspended-bed reactor after conducting the hydrotreating of the heavy oil for a given period of time, followed by feeding of a fresh catalyst in an amount equivalent to that of the withdrawn catalyst into the suspended-bed reactor in order to keep the catalyst activity constant.

The impurities having low reactivities with hydrogen, contained in the heavy oil must also be removed for finally obtaining a product oil of high quality.

In the conventional process comprising hydrotreating the heavy oil only with the use of the suspended bed, impurities having high reactivities with hydrogen and impurities having low reactivities with hydrogen are simultaneously removed under severe conditions, so that not only does the deposition of metals on the catalyst occur in a large amount but also the fraction containing impurities having high reactivities with hydrogen undergoes excess decomposition to thereby cause coke deactivation of the catalyst.

By contrast, in the process of the present invention, impurities having high reactivities with hydrogen may mainly be removed during the hydrotreating of the heavy oil in the step (a), and thus the catalyst of the suspended-bed reactor may mainly be used for the removal of impurities having low reactivities with hydrogen during the hydrotreating of the heavy oil in the step (b). When the catalyst of the suspended-bed reactor is effectively utilized in the removal of impurities having low reactivities with hydrogen as mentioned above, nuclear hydrogenation reaction of the heavy oil is promoted.

In the process of the present invention, the degradation of the product oil can be prevented by promoting the nuclear hydrogenation reaction of the heavy oil in the above manner.

In the process using the apparatus of the present invention, further, it is feasible in the step (b) that a feed oil containing vanadium and nickel (V+Ni) in a total amount of not more than 10 ppm, preferably not more than 5 ppm, e.g., vacuum gas oil, deasphalted oil or feed oil containing foreign matters such as slurry oil, can be fed to the suspended-bed reactor in addition to the heavy oil from which impurities having high reactivities with hydrogen are removed in the step (a), to thereby effect hydrotreating of those oils together. In this case, it is desirable that the proportion of the new feed oil to the heavy oil hydrotreated in the step (a) is in the range of 0.5 to 50% by volume, preferably 1 to 10% by volume. By the use of the apparatus of the present invention, moreover, a product oil having a low boiling point can be obtained by effecting the hydrotreating of the step (b) for the main purpose of hydrocracking.

The hydrotreating catalyst employed in the above step (b) is preferably a highly active catalyst composed of a hydrogenation metal component and an inorganic oxide carrier, having the following properties:

| | Range | Still preferred range |
|---|---|---|
| Pore volume (P.V) | at least 0.50 ml/g | 0.55–1.10 ml/g |
| Average pore diameter (P.D) | at least 70 Å | 80–500 Å |
| Specific surface area (S.A) | at least 120 $m^2/g$ | 150–400 $m^2/g$ |
| Average diameter of catalyst particles (Dia) | up to 1/8 inch | 1/32–1/16 inch. |

The catalyst having the same composition as that of the catalyst employed in the step (a) may be used in the step (b).

In the case that the hydrotreating is effected for the main purpose of hydrocracking in the step (b), the inorganic oxide carriers preferably used are those having solid acids, such as silica-alumina, Y-type zeolite (including USY), mordenite and ZSM-5. As the catalyst particles, there can be preferably used those within a range of from divided particles having an average diameter of about 20 to 200 μm to molded product particles having an average diameter of not more than 1/16 inch.

For performing highly effective hydrotreating of the feed heavy oil, it is preferred that the hydro-treating in the step (b) be conducted under the following conditions:

| | Range | Still preferred range |
|---|---|---|
| Reaction temperature (°C.) | 350–450 | 380–430 |
| Reaction hydrogen pressure ($kg/cm^2$) | 50–250 | 100–240 |
| Liquid space velocity ($hr^{-1}$) | 0.2–10.0 | 0.25–8.0 |
| Ratio of hydrogen to oil ($nM^3/kl$) | 500–3000 | 800–2500 |
| Ratio of catalyst to oil (vol/vol) | 1/10–5/1 | 1/8–4/1. |

The effects desired in the present invention may not be obtained when the hydrotreating is conducted under the conditions falling outside the above ranges.

When the hydrotreating is conducted under the conditions falling below the above lower limits, the removal of impurities having low reactivities may not reach a desired level. On the other hand, when the hydrotreating is conducted under the conditions exceeding the above upper limits, the thermal cracking of the heavy oil may preferentially be advanced to thereby degrade the quality of the product oil.

In the present invention, the above step (b) may be conducted with the use of one or at least two suspended-bed reactors.

Next, constitution of the apparatus for hydrotreating a heavy oil according to the present invention will be illustrated in more detail with reference to FIG. 1 and FIG. 5 of the attached drawings.

FIG. 1 shows one preferred embodiment of the apparatus for hydrotreating a heavy oil according to the present invention. The hydrotreating apparatus of this embodiment comprises (a') fixed-bed reactors 1 to 3 packed with a hydrotreating catalyst for hydrotreating a heavy oil and (b') a suspended-bed reactor 4 packed with a hydrotreating catalyst for hydrotreating the heavy oil hydrotreated in the fixed-bed reactors 1 to 3.

In the hydrotreating apparatus of this embodiment, for the purpose of hydrotreating of a heavy oil, the three fixed-bed reactors 1 to 3 are each packed with a hydrotreating catalyst for hydrotreating a heavy oil under mild conditions so as to remove impurities having high reactivities with hydrogen, and the one suspended-bed reactor 4 is packed with a hydrotreating catalyst for hydrotreating the heavy oil hydrotreated in the fixed-bed reactors 1 to 3 so as to remove impurities contained in the heavy oil and having low reactivities with hydrogen.

In the fixed-bed reactors 1 to 3, a feed pipe 5 for feeding a heavy oil and hydrogen is disposed at the upper part of the first fixed-bed reactor 1, and an discharge pipe 7 for discharging the hydrotreated heavy oil is disposed at the lower part of the last fixed-bed reactor 3. The discharge pipe 7 includes a sampling port V-3 for sampling the hydrotreated heavy oil. The sample withdrawn from the sampling port V-3 is analyzed, and thereby the reaction conditions are set so that only impurities having high reactivities with hydrogen are removed. The lower parts of the plural fixed-bed reactors 1, 2 are each connected with the upper parts of the next reactors 2, 3 through connecting pipes 6, 8, respectively. The upper parts of the reactors 1 to 3 may be each provided with a hydrogen feed means (not shown) according to necessity.

The bottom of the suspended-bed reactor 4 is connected with a connecting pipe 7 and includes a discharge pipe 10 for discharging a reaction product containing a product oil. The bottom and the upper part of this reactor 4 are connected through a connecting pipe 11, and midway of this connecting pipe 11 is disposed a high-pressure pump 13. The high-pressure pump 13 serves to recycle the heavy oil upward from the lower part in the reactor 4 to maintain the catalyst in a suspended state. The suspended-bed reactor 4 further includes a catalyst withdrawal port V-2 for withdrawing a part of the catalyst used and a catalyst feed port V-1 for feeding a fresh catalyst in an amount equal to that of the withdrawn catalyst. The catalyst withdrawal port V-2 and the catalyst feed port V-1 are connected with a catalyst withdrawal apparatus (not shown) and a catalyst feed apparatus (not shown), respectively.

In the hydrotreating apparatus of the embodiment illustrated above, the step (a) of the aforesaid process can be carried out in the fixed-bed reactors 1 to 3, and the step (b) thereof can be carried out in the suspended-bed reactor 4.

The apparatus for hydrotreating a heavy oil according to the present invention is in no way limited to this embodiment. For example, plural suspended-bed reactors may be provided, and in this case, the hydrotreated heavy oil discharged from the last fixed-bed reactor is fed through a connecting pipe to a bottom part of the first suspended-bed reactor, and a part of the intermediate or end product from the upper part of each suspended bed may be recycled to the bottom thereof through a connecting pipe, midway of which a high-pressure pump for recycling the heavy oil in the reactor may be disposed to maintain the catalyst in a suspended state. In this case, further, each suspended-bed reactor may be connected with the bottom of the next suspended-bed reactor through a gas-liquid separator and a connecting pipe, whereby a part of a product oil can be fed as an objective oil of hydrotreating to the bottom of the reactor together with hydrogen.

The discharge pipe 10 for discharging a reaction product may be provided with a gas-liquid separator (not shown) for separating the reaction product into a product oil and a gaseous matter. In the gas-liquid separator, the reaction product obtained by hydrotreating in the suspended-bed reactor 4 is separated into a product oil and gaseous matters such as hydrogen sulfide and unreacted hydrogen. Then the hydrogen sulfide or the like is removed, and the unreacted hydrogen is recycled for the use in the further reaction. A part of the product oil separated by the gas-liquid separator may be recycled toward the bottom of the reactor 4 by means of the high-pressure pump 13 to maintain the catalyst in the reactor in a suspended state.

The suspended-bed reactor 4 may furthermore includes a feed oil side feed means for feeding a feed oil containing vanadium and nickel (V+Ni) in a total amount of not more than 10 ppm, such as slurry oil or vacuum gas oil, to the suspended-bed reactor to thereby effect hydrotreating of such feed oil together with the heavy oil hydrotreated in the fixed-bed reactors 1 to 3. Thus, a mixture of the new feed oil and the heavy oil hydrotreated in the fixed-bed reactors 1 to 3 can be hydrotreated in the suspended-bed reactor 4, and as a result, the hydrotreating capability can be increased. The hydrotreating apparatus of this constitution has such an advantage that hydrotreating of a feed oil containing foreign matters, such as slurry oil, is feasible. As the new feed oil such as slurry oil or vacuum gas oil contains metal impurities such as vanadium and nickel in small amounts, the degree of catalyst deterioration is low, so that the catalyst can be efficiently used for the nuclear hydrogenation, with the result in that the product oil is free from degrading even if the new feed oil is mixed with the heavy oil hydrotreated in the fixed-bed reactor.

Next, another preferred embodiment of the hydrotreating apparatus of the present invention is described with reference to FIG. 5 of the attached drawings.

Figure 5:
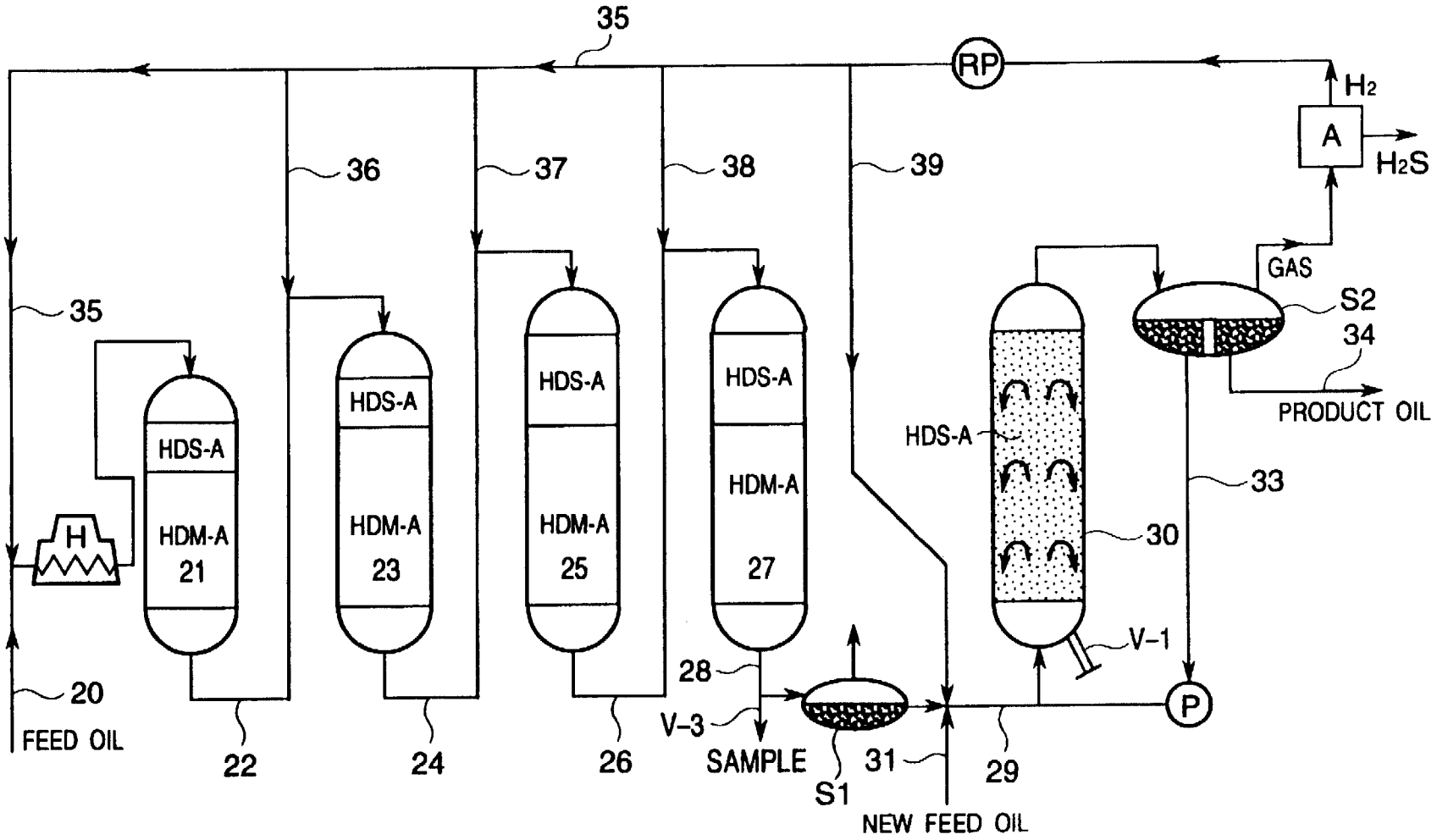
FIG. 5 shows another preferred embodiment of the hydrotreating apparatus according to the present invention.

In FIG. 5, a heavy oil fed through a feed oil feed pipe 20 is heated by a heating furnace H together with hydrogen and then fed to the upper part of the first fixed-bed reactor 21 packed with a hydrotreating catalyst. The heavy oil hydrotreated in the first fixed-bed reactor 21 is then introduced into the upper part of the second fixed-bed reactor 23 through a connecting pipe 22, further hydrotreated therein, then introduced into the third fixed-bed reactor 25 through a connecting pipe 24, and then introduced into the fourth fixed-bed reactor 27 through a connecting pipe 26. Thus, hydrotreating of the heavy oil is gradually performed in those reactors. The heavy oil subjected to the hydrotreating of the aforesaid step (a) is discharged from the lower part of the fourth fixed-bed reactor 27 through a discharge pipe 28. The discharge pipe 28 disposed at the lower part of the fourth fixed-bed reactor 27 is connected with the bottom of the suspended-bed reactor 30 through a flashing apparatus S1 that is disposed according to necessity and through a feed pipe 29, whereby the heavy oil discharged from the lower part of the fourth fixed-bed reactor 27 is fed to the bottom of a suspended-bed reactor 30.

Midway of the discharge pipe 28, a sampling port V-3 for sampling the heavy oil discharged from the fourth fixed-bed reactor is disposed. The sample withdrawn from the sampling port V-3 is analyzed (with respect to, for example, its demetallization rate of vanadium and nickel (V+Ni)), and based on the data obtained by the analysis, the reaction conditions, specifically reaction temperature, reaction hydrogen pressure, liquid space velocity, hydrogen/oil ratio, are adjusted within the aforesaid range so that only impurities having high reactivities with hydrogen are removed (for example, the demetallization rate of (V+Ni) becomes not more than 80%).

The feed pipe 29 is connected with a new feed oil feed pipe 31 arranged downstream of the flashing apparatus S1. Through the new feed oil feed pipe 31, a new feed oil, such as vacuum gas oil or slurry oil, is fed.

On the bottom of the suspended-bed reactor 30, a catalyst port V-1 is disposed. This catalyst port V-1 serves as an outlet through which a part of the used catalyst is withdrawn and also as an inlet through which a fresh catalyst in an amount equal to that of the withdrawn catalyst can be fed.

The suspended-bed reactor 30 is packed with a hydrotreating catalyst in a suspended state, and this reactor is an adiabatic reactor which is so designed that the reaction temperature is maintained by reaction heat of the hydrogenation reaction. The reaction product obtained by the hydrotreating in the suspended-bed reactor 30 is introduced into a gas-liquid separator S2 and separated into a product oil and a gaseous matter. A part of the product oil separated by the gas-liquid separator S2 is recycled by means of a recycling pipe 33 and a high-pressure pump P arranged midway of the recycling pipe 33, and the remainder is discharged as a product oil from a product oil discharge pipe 34. The unreacted hydrogen and other gaseous matters separated by the gas-liquid separator S2 were introduced into an amine scrubber A, wherein other gaseous matters such as hydrogen sulfide are removed to purify hydrogen. The thus purified hydrogen is recycled and fed to a heating furnace H through a main recycling pipe 35, midway of which a recycling pump RP is disposed, and through a feed oil feed pipe 20 connected with the main recycling pipe 35. Besides, the purified hydrogen is also recycled and fed to the reactors 21, 23, 25, 27 and 30 through branched recycling pipes 36, 37, 38 and 39 each arranged downstream of the recycling pump RP and through the connecting pipes 22, 24, 26 and 29 connected with the branched recycling pipes 36, 37, 38 and 39, respectively.

In the hydrotreating apparatus of this embodiment illustrated above, the step (a) can be carried out in the fixed-bed reactors 21, 23, 25 and 27, and the step (b) can be carried out in the suspended-bed reactor 30.

The state of the hydrotreating operation by the apparatus of the present invention and the results will be illustrated in more detail with reference to the following examples.

EXAMPLE 1

The atmospheric distillation residue specified in Tables 3 and 4 as a feed oil was subjected to a high-degree hydrotreating reaction test through the apparatus shown in FIG. 1 for a prolonged period of time.

Illustratively, the three fixed-bed reactors 1–3 were packed with the catalyst for step (a), HDM-A, having the properties specified in Tables 1 and 2 according to the densely packing technique, and the suspended-bed reactor 4 was installed which permitted feeding thereinto and withdrawal therefrom of the catalyst for step (b). In this suspended-bed reactor 4, the flow rate of the heavy oil was regulated so as to cause the catalyst fed in the suspended-bed reactor 4 to be in the suspended state by recycling part of the heavy oil hydrotreated in the step (b) with the use of a high-pressure pump 13.

The suspended-bed reactor 4 was packed with the catalyst HDS-A specified in Tables 1 and 2 as the catalyst for step (b). This catalyst was sulfidized at 290° C. for 48 hr with the use of an untreated straightrun light oil, which was replaced by the feed oil to thereby carry out hydrotreating of the feed oil. The same sulfidization of the catalyst was conducted in the Comparative Examples as well.

In this Example, 72% by volume of the total catalyst was used in the fixed-bed reactors, and 28% by volume thereof was used in the suspended-bed reactor.

Figure 2:
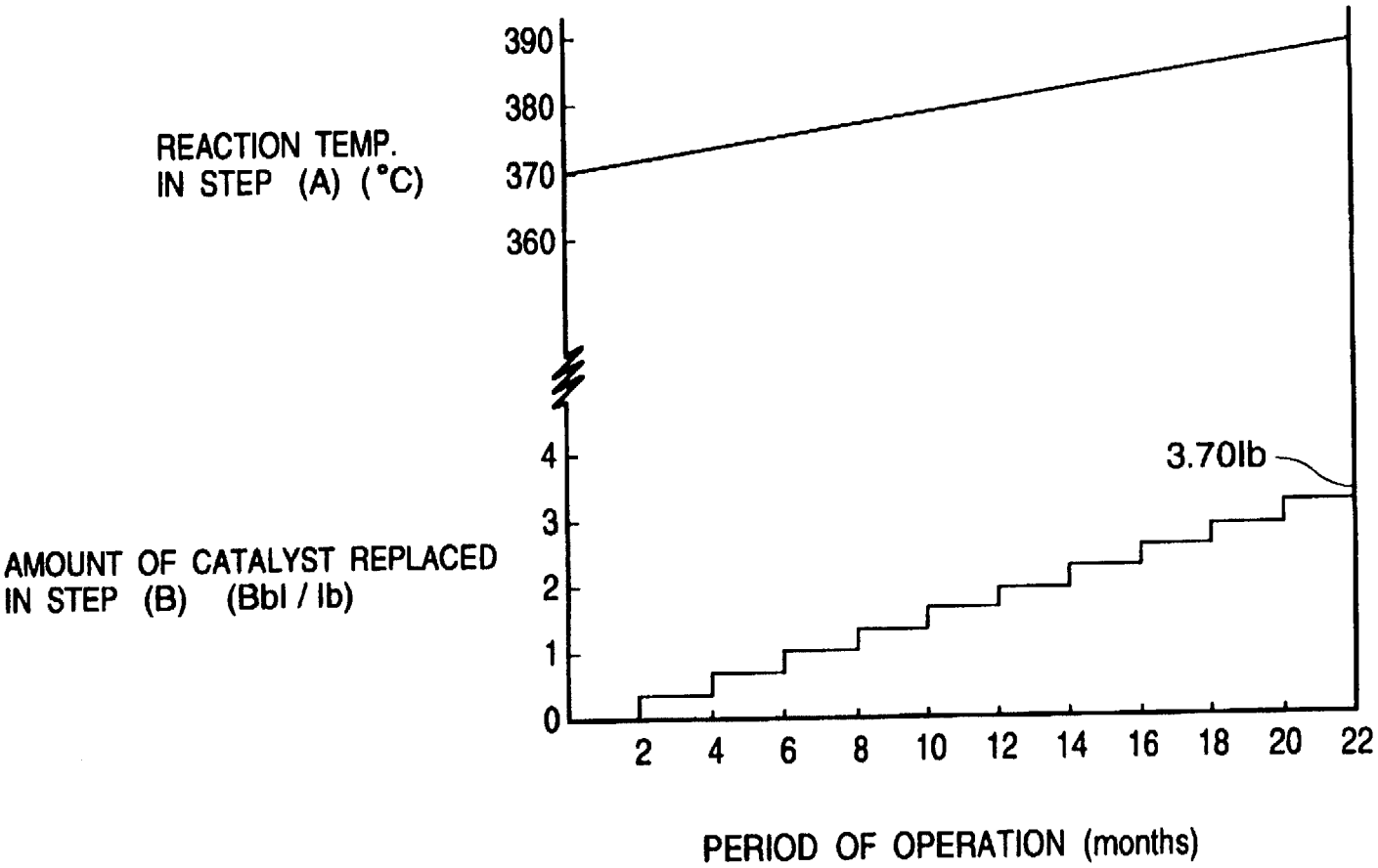
FIG. 2 graphically shows results of the hydrotreating operation of Example 1 in which hydrotreating is carried out for a period of 22 months.

In the step (a), the heavy oil was hydrotreated while regulating the reaction temperature as indicated in FIG. 2 so as to cause the (V+Ni) demetallization rate of the product oil to be kept at 45–47%, under the conditions such that the hydrogen pressure was 150 kg/cm$^2$, the LHSV was 0.2 hr$^{-1}$, and the $H_2$/HC was 700 nM$^3$/kl. Accordingly, in the three fixed-bed reactors 1–3 employed in the step (a), the temperature difference between the inlet of the fixed-bed reactor 1 and the outlet of the fixed-bed reactor 3 was regulated at 22° C., and the reaction temperature (WAT) of the fixed-bed reactor 1–3 was shown in FIG. 1. The hydrotreated heavy oil was sampled from the outlet of the fixed-bed reactor 3 and analyzed according to necessity, and the conditions were so set as to remove only impurities having high reactivities with hydrogen.

In the suspended-bed reactor 4 employed in the step (b), the catalyst was suspended in the heavy oil hydrotreated in the step (a), and, while maintaining the suspended state, a high-degree hydrotreating of the heavy oil was performed at a reaction temperature kept at 395° C. for a prolonged period of time under the conditions such that the hydrogen pressure was 150 kg/cm$^2$, the LHSV was 0.2 hr$^{-1}$, and the $H_2$/HC was 700 nM$^3$/kl, so that the sulfur content of the $C_5^+$ fractions (fractions each having at least 5 carbon atoms) of the heavy oil hydrotreated in the step (b) was 0.3% by weight. The catalyst incorporated in the suspended-bed reactor 4 and used in the step (b) was withdrawn through a catalyst withdrawal port V-2 disposed at a lower part of the suspended-bed reactor 4 as shown in FIG. 1 in an amount corresponding to the degree of deactivation of the catalyst, and fresh catalyst was fed through a catalyst feed port V-1 disposed at an upper part of the suspended-bed reactor 4 in an amount equal to that of the withdrawn catalyst.

A fixed amount of the catalyst was withdrawn from the suspended-bed reactor 4 and fresh catalyst was fed thereinto every two months as indicated in FIG. 2. The total amount of catalyst used for a period of 22 months was 5.13 lb.

In this Example, the hydrotreating was started in the presence of 1.03 lb of catalyst in the step (a) and 0.40 lb of catalyst in the step (b), and a total of 10 catalyst replacements were carried out each in an amount of 0.37 lb from two months thereafter, while the amount of heavy oil passed for hydrotreating was 19.72 Bbl, so that, in the total, the amount of heavy oil hydrotreated per weight of the catalyst was 3.84 Bbl/lb.

The characteristics of heavy oil hydrotreated in this Example for a period of 22 months are shown in FIG. 2. The properties of first-stage and final product oils at one month from the start of heavy oil hydrotreating run (SOR) on the one hand and at one month before the end of heavy oil hydrotreating run (EOR) on the other hand are shown in Tables 3 and 4, respectively.

Comparative Example 1

Figure 3:
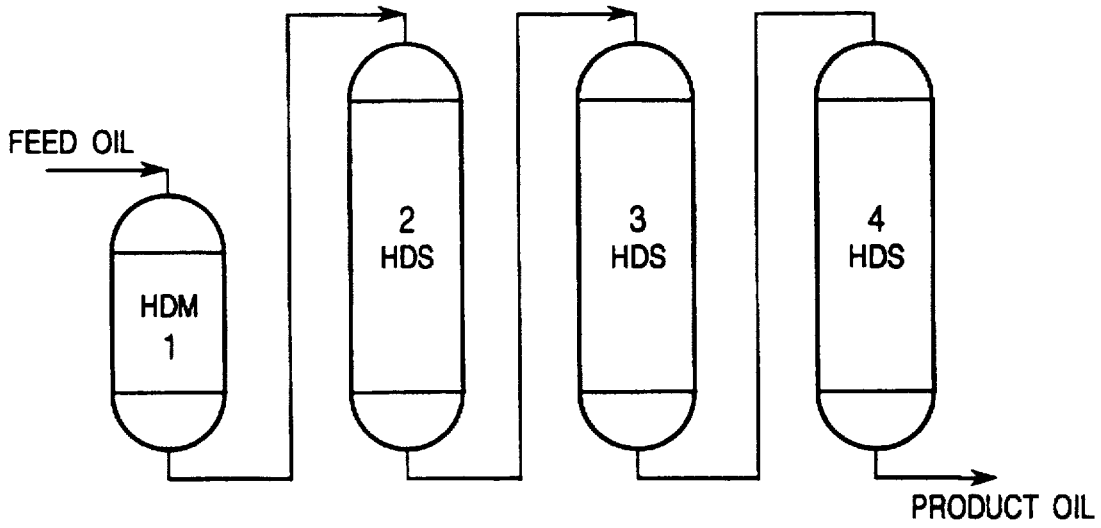
FIG. 3 shows a hydrotreating apparatus used in Comparative Example 1.

Four conventional fixed-bed reactors were employed as shown in FIG. 3, and the difference between the temperature of the inlet of the fixed-bed reactor 1 and the temperature of the fixed-bed reactor 4 was adjusted to 30° C. Hydrotreating catalyst for step (a) HDM-A was charged into the fixed-bed reactor 1 and an upper part of the fixed-bed reactor 2, and hydrotreating catalyst for step (b) HDS-A was charged into a lower part of the fixed-bed reactor 2 and the fixed-bed reactors 3 and 4. Hydrotreating durability test was started while changing the reaction temperature under the same conditions as in the step (a) of Example 1 so as to cause the sulfur content of the product oil to be 0.30% by weight.

More specifically, hydrotreating catalyst for step (a) HDM-A specified in Tables 1 and 2 was charged into the fixed-bed reactor 1 and an upper part of the fixed-bed reactor 2 in respective amounts of 16% and 4% by volume, and hydrotreating catalyst for step (b) HDS-A specified in Tables 1 and 2 was charged into a lower part of the fixed-bed reactor 2 and the fixed-bed reactors 3 and 4 in respective amounts of 24%, 28% and 28% by volume. Then, hydrotreating of the heavy oil was carried out.

However, the reaction temperature (WAT) became 400° C. when the amount of hydrotreated heavy oil was 1.92 Bbl/lb at 2000 hr of heavy oil passage for hydro-treating, thereby resulting in the formation of dry sludge. Thus, the conditions were changed so as to cause the sulfur content of the product oil to be 0.6% by weight, and the hydrotreating of the heavy oil was continued. However, the catalyst layer had a pressure drop inside the same at 4000 hr (lapse of 166 days) and at 3.83 Bbl/lb, so that the durability test was discontinued.

Comparative Example 2

Figure 4:
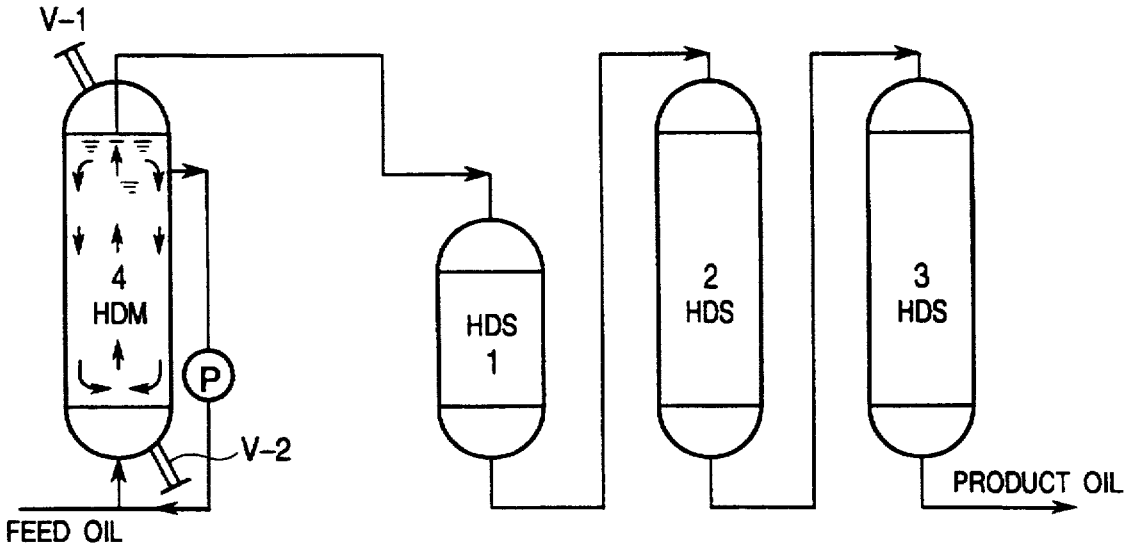
FIG. 4 shows a hydrotreating apparatus used in Comparative Example 2.

Hydrotreating of a heavy oil as a raw material which is the same oil as used in Example 1 was carried out using a hydrotreating apparatus shown in FIG. 4, in which a suspended-bed reactor 4 packed with the catalyst, HDM-A, shown in Tables 1 and 2 was used at a first step and first to third fixed-bed reactors 1, 2 and 3 each packed with the catalyst, HDS-A, shown in Tables 1 and 2 were used at a second step.

In the suspended-bed reactor 4, the hydrotreating was carried out in the same conditions as in Example 1 in which a hydrogen pressure was 150 kg/cm$^2$, LHSV was 0.2 hr$^{-1}$ and $H_2$/HC was 700 nM$^3$/kl with maintaining a reaction temperature constantly at 395° C., and a fresh HDM-A catalyst was loaded in an amount of 0.37 lb/2 months therein from the catalyst feed means V-1, while the same amount of the catalyst used was withdrawn from the catalyst withdrawal means V-2.

In the fixed-bed reactors, the further hydrotreating was carried out in the same conditions as in Example 1 except that the reaction temperature was controlled such that sulfur content in $C^{5+}$ fraction (fraction having more than 5 carbon atoms) of the product oil at the fixed-bed reactor 3 became 0.3% by weight.

However, the catalyst in the reactors 1, 2 and 3 was extremely deactivated and the operation temperature reached an upper limit after only 4 months, so that the hydrotreating operation had to stop. That is, only 4 months life was shown in this process and apparatus.

TABLE 1

Properties of Hydrotreating Catalyst

| | Catalyst for Step (a) HDM-A | Catalyst for Step (b) HDS-A |
|---|---|---|
| Size of Catalyst (inch) | 1/22 (cylindrical) | 1/22 (cylindrical) |
| Apparent Bulk Density (ABD) (g/ml) | 0.55 | 0.55 |
| Bulk Density (CBD) (g/ml) | 0.65 | 0.65 |
| Specific Surface Area (S.A.) (m$^2$/g) | 192 | 220 |
| Pore Volume (P.V.) (ml/g) | 0.60 | 0.60 |
| Pore Diameter (P.D.) (Å) | 125 | 110 |

TABLE 2

| Properties of Hydrotreating Catalyst | Catalyst for Step (a) HDM-A | Catalyst for Step (b) HDS-A |
|---|---|---|
| $MoO_3$ (wt %) | 6.5 | 10.5 |
| CoO (wt %) | 1.5 | 0.9 |
| NiO (wt %) | 1.5 | 1.5 |
| $V_2O_5$ (wt %) | 4.5 | 0 |

TABLE 3

| | | SOR [1] | |
|---|---|---|---|
| | Feed Oil | Reaction Product Oil of Step (a) | Reaction Product Oil of Step (b) |
| Density (15° C. g/ml) | 0.990 | 0.934 | 0.921 |
| Sulfur (wt %) | 4.08 | 0.65 | 0.30 |
| Conradson carbon residue (CCR) (wt %) | 15.0 | 6.8 | 2.5 |
| Ni (wtppm) | 26 | 15 | 3 |
| V (wtppm) | 91 | 47 | 5 |
| Insoluble Asphaltene in n-Hexane (wt %) | 8.2 | 7.2 | 2.0 |
| Nitrogen (wtppm) | 2670 | 1602 | 700 |
| Dry sludge (wt %) | 0.0 | 0.0 | 0.01 |
| (Ni + V) Demetallization rate (%) | — | 47.0 | 93.1 [2] |

[1] SOR = at the start of run (Start of Run)
[2] Demetallization rate based on feed oil

TABLE 4

| | | EOR [3] | |
|---|---|---|---|
| | Feed Oil | Reaction Product Oil of Step (a) | Reaction Product Oil of Step (b) |
| Density (15° C. g/ml) | 0.990 | 0.930 | 0.920 |
| Sulfur (wt %) | 4.08 | 0.60 | 0.30 |
| Conradson carbon residue (CCR) (wt %) | 15.0 | 6.7 | 3.0 |
| Ni (wtppm) | 26 | 14 | 4 |
| V (wtppm) | 91 | 50 | 6 |
| Insoluble Asphaltene in n-Hexane (wt %) | 8.2 | 7.0 | 1.6 |
| Nitrogen (wtppm) | 2670 | 1670 | 780 |
| Dry sludge (wt %) | 0.0 | 0.0 | 0.01 |
| (Ni + V) Demetallization rate (%) | — | 45.3 | 91.4 [4] |

[3] EOR = at the end of run (End of Run)
[4] Demetallization rate based on feed oil

EXAMPLE 2

The fixed-bed reactors 21, 23, 25 and 27 shown in FIG. 5 were packed with a catalyst HDM-A and a catalyst HDS-A both shown in Table 1 in respective amounts of 80% and 20% by volume, and the liquid space velocity (LHSV) in the step (a) was adjusted to 0.26 $hr^{-1}$. The suspended-bed reactor 30 for the step (b) was packed with the catalyst HDS-A in an amount corresponding to 42% by volume of the total of the catalyst in all the fixed-bed reactors, and the LHSV in the step (b) was adjusted to 0.63 $hr^{-1}$.

A feed oil (Arabian Light) having properties shown in Table 5 was fed through a feed pipe 20, and the temperature difference among the reactors 1 to 4 for the step (a) was adjusted to 15° C. In the step (a), the reaction pressure was 135 $kg/cm^2$ (1,928 psi), the LHSV was 0.26 $hr^{-1}$, the catalyst weight average temperature (WAT) was 351° C. (664° F.), and the hydrogen/oil ($H_2$/HC) ratio was 1,000 $nM^3/kl$.

The intermediate product oil obtained by hydrotreating in the fixed-bed reactors 21, 23, 25 and 27 under the above operation conditions was withdrawn from a sampling port V-3. The properties of the intermediate product oil were analyzed. The results of the analysis are set forth in Table 6.

The intermediate product oil was fed to the bottom of the suspended-bed reactor 30 through a flashing apparatus S1 and a feed pipe 29, while slurry oil having properties shown in Table 8 was fed through a new feed oil feed pipe 31 in an amount corresponding to 5% by volume of the feed oil initially fed to mix it with the intermediate product oil. Properties of the mixed oil of the new feed oil and the intermediate product oil are set forth in Table 6.

The mixed oil was then hydrotreated in the suspended-bed reactor 30 for the step (b), and the properties of the product oil obtained were analyzed. The results of the analysis are set forth in Table 7.

Separately, the intermediate product oil was directly subjected to hydrotreating without mixing with the slurry oil. The properties of the product oil obtained were analyzed. The results of the analysis are set forth in Table 7. It has confirmed from the results in Table 7 that there is scarcely any difference between the properties of those product oils, and the hydrotreating capability can be increased.

The suspended-bed reactor 30 was an addiabatic rector, so that, although the reaction temperature in the step (a) was 351° C., the reaction temperature in the step (b) rose up to 405° C. (761° F.) because of reaction heat of the hydrogenation reaction even when no slurry oil was added. When the slurry oil was added, hydrogen reaction with the slurry oil newly took place, so that the reaction temperature further rose by 2.5° C. (5° F.) owing to the exothermic heat.

It has been confirmed that by the use of the exothermic heat of the hydrogenation reaction, the reaction temperature in the suspended-bed reactor 30 of FIG. 5 can be maintained at a temperature higher than that of the step (a) by as high as 54° C. (405° C. (b) −351° C. (a)), to thereby effect extra hydrotreating of a heavy oil such as slurry oil without any problem.

Subsequently, the above hydrotreating run with mixing of slurry oil was continued, and a life test for evaluating a life in continuation of the step (a) and the step (b) was carried out. As a result, no pressure loss among the fixed-bed reactors 21, 23, 25 and 27 in the step (a) occured, and continuous operation over 23 months was feasible without forming a large amount of dry sludge in the final product. In the step (a), the reaction temperature (WAT) at the time the reaction was initiated was 355° C., and after 22 months it rose to 390° C. In the step (b), the reaction temperature (WAT) was kept at 405° to 408° C., and sulfur and Ni+V contained in the product oil were able to be maintained in amounts of not more than 0.4 wt % and not more than 7 wtppm, respectively.

TABLE 5

| Properties of Feed Oil | |
|---|---|
| Density (15° C. g/ml) | 0.950 |
| Sulfur (wt %) | 2.30 |
| Nitrogen (wtppm) | 2,350 |
| Asphaltene (wt %) | 2.9 |
| Viscosity (cSt @ 122 °F.) | 160 |
| MCR (wt %) *1) | 7.6 |
| Ni/V (wtppm) | 12/13 |
| Distillation (wt %) | |
| $C_5$–350° F. | 0.3 |
| 375–650° F. | 9.6 |
| 650–1,040° F. } 1,040° F.+ | 90.1 |

*1) MCR: Micro Carbon Residue

TABLE 6

| | Properties of Intermediate Product Oil | Properties of Mixed Feed Oil |
|---|---|---|
| Density (15° C. g/ml) | 0.929 | 0.935 |
| Sulfur (wt %) | 0.679 | 0.716 |
| Nitrogen (wtppm) | 1,890 | 1,920 |
| Asphaltene (wt %) | 0.8 | 1.2 |
| Viscosity (cSt @ 122° F.) | 90.6 | 110 |
| MCR (wt %) *1) | 4.9 | 5.0 |
| Ni/V (wtppm) | 5/7 | 5/8 |
| Demetallization Rate (wt %) | 70 | — |
| Distillation (wt %) | | |
| $C_1$–$C_4$ | — | 0 |
| $C_5$–350° F. | 0.1 | 0.5 |
| 375–650° F. | 15.2 | 13.4 |
| 650–1,040° F. | 62.0 | 63.4 |
| 1,040° F.+ | 22.3 | 22.7 |
| $-H_2$ *2) (SCF/B) | 800 | — |
| Dry sludge (mg) | — | trace |

*1) MCR: Micro Carbon Residue
*2) Chemical Hydrogen Consumption

TABLE 7

| Properties of Product Oil | Addition of Slurry Oil | Non-addition of Slurry Oil |
|---|---|---|
| Density (15° C. g/ml) | 0.905 | 0.902 |
| Sulfur (wt %) | 0.337 | 0.330 |
| Nitrogen (wtppm) | 950 | 915 |
| Asphaltene (wt %) | 1.2 | 0.8 |
| Viscosity (cSt @ 122° F.) | 18.6 | 19.0 |
| MCR (wt %) *1) | 3.6 | 3.3 |
| Ni/V (wtppm) | 3/2 | 2/1 |
| Distillation (wt %) | | |
| $C_1$–$C_4$ | 2.3 | 2.2 |
| $C_5$–350° F. | 10.2 | 7.6 |
| 375–650° F. | 24.8 | 26.2 |
| 650–1,040° F. | 51.7 | 51.7 |
| 1,040° F.+ | 13.3 | 14.5 |

TABLE 7-continued

| Properties of Product Oil | Addition of Slurry Oil | Non-addition of Slurry Oil |
|---|---|---|
| $-H_2$ *2) (SCF/B) | 370 | 310 |
| Dry sludge (mg) | trace | trace |

*1) MCR: Micro Carbon Residue
*2) Chemical Hydrogen Consumption

TABLE 8

| Properties of Slurry Oil | |
|---|---|
| Density (15° C. g/ml) | 1.046 |
| Sulfur (wt %) | 0.716 |
| Nitrogen (wtppm) | 2,605 |
| MCR (wt %) *1) | 8.0 |
| Ni/V (wtppm) | 2/3 |

*1) MCR: Micro Carbon Residue

Comparative Example 3

Figure 6:
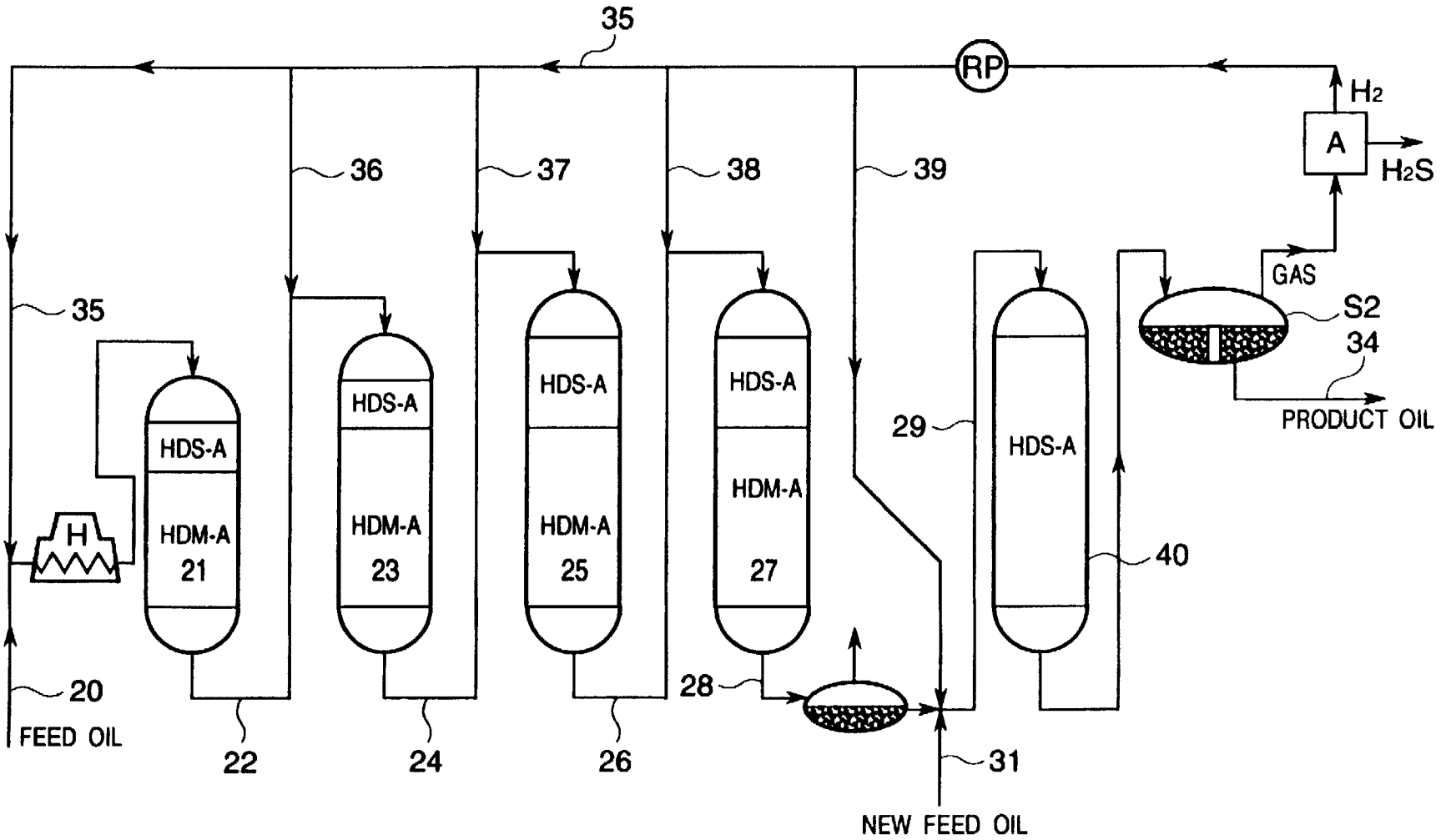
FIG. 6 shows a hydrotreating apparatus used in Comparative Example 3.

Hydrotreating of a feed oil was carried out using a hydrotreating apparatus shown in FIG. 6 in place of the apparatus shown in FIG. 5. The hydrotreating apparatus of FIG. 6 is an apparatus in which the suspended-bed reactor 30 of FIG. 5 was replaced with a fixed-bed reactor 40 having the same size as that of the suspended-bed reactor 30. In FIGS. 5 and 6, the same parts are indicated with the same symbols, and illustration of those parts is omitted herein. The fixed-bed reactor 40 is an adiabatic reactor, and is not provided with a liquid recycling line and a liquid recycling pump because the catalyst do not need to be maintained in a suspended state.

The reaction was initiated under the same conditions as in Example 2. In the fixed-bed reactors 21, 23, 25 and 27, the hydrotreating began under the same conditions as those in Example 2, but in the fixed-bed reactor 40, the reaction temperature rose by 50° C. because heat was generated by the hydrogen reaction. After the operation period of 6 months, in the step (a), the reaction temperature (WAT) became 370° C. and the temperature of the catalyst bed at the lowest part of the fixed-bed reactor 40 became 420° C. Further, a large amount of dry sludge was formed and the final product discharged from a product oil discharge port 34 was degraded, so that continuation of the operation was in vain.

In the apparatus of FIG. 6, 5% by volume of slurry oil was fed through the new feed oil feed pipe 31 to effect hydrotreating in a manner similar to that of Example 2. As a result, heat was generated in the fixed-bed reactor 40 as well as in the case of feeding no new feed oil. In addition, because of the FCC catalyst powder contained in the slurry oil, choking of the reactor 40 took place to thereby rise the pressure loss, so that the operation became unfeasible. The period of time in which the operation was feasible was 7 months.

EFFECT OF THE INVENTION

In the present invention, first, the fixed-bed reactor selectively removes impurities contained in resin or the like and having high reactivities with hydrogen at the time of hydrotreating of a heavy oil among impurities contained in the heavy oil. Subsequently, the suspended-bed reactor selectively removes impurities contained in asphaltene or the like and having low reactivities with hydrogen.

Therefore, the present invention can suppress the deactivation of the hydrotreating catalyst in the fixed-bed reactor, so that replacing of the catalyst in the fixed-bed reactor is not necessary for a prolonged period of time. Moreover, continuous catalyst replacement can be performed in the suspended-bed reactor. Thus, as a whole, the period of time in which hydrotreating of the heavy oil is effected can be prolonged.

I claim:

1. A hydrotreating apparatus for hydrotreating a heavy oil, wherein the apparatus comprises:

(a') at least one fixed-bed reactor packed with a hydrotreating catalyst for hydrotreating a heavy oil to remove impurities having high reactivities with hydrogen, and (b') at least one suspended-bed reactor packed with a hydrotreating catalyst for further hydrotreating the heavy oil hydrotreated in the fixed-bed reactor to remove impurities contained in the heavy oil and having low reactivities with hydrogen, wherein the suspended-bed reactor includes means for side feeding a feed oil containing vanadium and nickel in a total amount of not more than 10 ppm to the suspended-bed reactor in addition to the hydrotreated heavy oil in the fixed-bed reactor.

2. The hydrotreating apparatus as claimed in claim 1, wherein the suspended-bed reactor includes means for maintaining the catalyst in the reactor in a suspended state by recycling a part of a product oil separated by a gas-liquid separator at high pressure toward the bottom of the reactor.

3. The apparatus as claimed in claim 1, wherein the apparatus includes at least two fixed-bed reactors.

4. The apparatus as claimed in claim 1, wherein the suspended-bed reactor is a moving-bed reactor.

5. The apparatus as claimed in claim 1, wherein the suspended-bed reactor is an ebullated-bed reactor.

6. The apparatus as claimed in claim 1, wherein the suspended-bed reactor further includes a catalyst withdrawal port and a catalyst feed port.

* * * * *

UNITED STATES PATENT AND TRADEMARK OFFICE

CERTIFICATE OF CORRECTION

PATENT NO. : 5,779,992

DATED : July 14, 1998

INVENTOR(S) : Hidehiro Higashi

It is certified that error appears in the above-identified patent and that said Letters Patent is hereby corrected as shown below:

Title Page, [56] References Cited, under U.S. PATENT DOCUMENTS, insert: --3,992,465 11/1976 Juguin et al.
5,196,110 3/1993 Swart et al.--.

Title Page, [57] ABSTRACT, line 5, after "reactor" and before the period, insert --is disclosed--.

Title Page, [57] ABSTRACT, line 7, after "fixed-bed reactor" delete --is disclosed--.

Column 7 Line 18 "ZSM-5" should read --ZSM-5-- (delete bold).

Signed and Sealed this

Sixteenth Day of March, 1999

*Attest:*

Q. TODD DICKINSON

*Attesting Officer*

*Acting Commissioner of Patents and Trademarks*